United States Patent [19]

Shoults

[11] 4,133,706

[45] Jan. 9, 1979

[54] PROPELLANTS CONTAINING CARBORANYLMETHYL ALKYL SULFIDE PLASTICIZERS

[75] Inventor: Royland D. Shoults, Fayetteville, N.C.

[73] Assignee: The United States of America as represented by the Secretary of the Army, Washington, D.C.

[21] Appl. No.: 293,256

[22] Filed: Oct. 3, 1972

[51] Int. Cl.[2] ..... C06D 5/06

[52] U.S. Cl. ..... 149/19.4; 149/19.9; 149/20; 149/22

[58] Field of Search ..... 149/19, 20, 22, 19.4, 149/19.6

[56] References Cited

U.S. PATENT DOCUMENTS 3,627,596 12/1971 Green ..... 149/19

*Primary Examiner*—Leland A. Sebastian

*Attorney, Agent, or Firm*—Nathan Edelberg; Robert P. Gibson; Jack W. Voigt

[57] ABSTRACT

Carboranylmethyl alkyl sulfides are disclosed along with propellant compositions which employ the sulfides as plasticizers. The propellant compositions using the carboranylmethyl alkyl sulfides yield high burning rates and possess good physical properties at high and low temperatures. Processability of the propellants are good and the quality of the propellants are quite attractive. Representative of the carboranylmethyl alkyl sulfides (CB plasticizers) are carboranylmethyl ethyl sulfide (CMES), carboranylmethyl n-propyl sulfide (CMPS), carboranylmethyl n-butyl sulfide (CMBS), carboranylmethyl iso-butyl sulfide (CMIBS), and carboranylmethyl iso-propyl sulfide (CMIPS). Mixture and eutectic mixtures of the carboranylmethyl alkyl sulfides are also employed. Eutectic mixtures of CMPS and CMES (20 to 80%) yield very low-melting-point plasticizers which are very attractive for propellants subjected to low temperature environments.

10 Claims, No Drawings

PROPELLANTS CONTAINING CARBORANYLMETHYL ALKYL SULFIDE PLASTICIZERS

BACKGROUND OF THE INVENTION

Carborane and derivatives of carborane belong to a class of compounds known to be effective ballistic modifiers for obtaining high burning rates. A number of derivatives of carborane also serve as effective plasticizers in composite propellants. n-Hexylcarborane (NHC) has been used in propellant, however, the low yield of the process for preparation and the complex process for preparation contribute to the high cost of n-hexylcarborane. Similarly, other alkyl carboranes have been prepared with corresponding results of high costs due to complexities of processes and the low yields (40%) thereof. Although extensive efforts have been spent toward improving the NHC process, no significant increases in yields have been achieved.

A simpler process than the NHC process is desired to produce derivatives of carborane in higher yield to result in lower cost than NHC or similar alkyl carboranes. The derivatives of carborane desired for propellant use must process compatibility, high yield and simple process of preparation, plasticizing effectiveness, high burning rates, and desirable properties to achieve good physical properties (stress/strain, etc.) of the propellant at high and low temperatures.

Therefore, the primary object of this invention is to provide propellant compositions which employ carboranylmethyl alkyl sulfides as effective plasticizers.

Another object of this invention is to provide high quality propellant compositions employing carboranylmethyl alkyl sulfides which contribute to good processing characteristics of the propellant.

A further object of this invention is to provide propellant compositions which yield high burning rates while employing carboranylmethyl alkyl sulfides.

An additional object of this invention is to provide propellant compositions which employ carboranylmethyl alkyl sulfides to yield improved mechanical properties of the propellants wherein used.

SUMMARY OF THE INVENTION

Propellant compositions of this invention employ carboranylmethyl alkyl sulfides selected from carboranylmethyl ethyl sulfide, carboranylmethyl n-propyl sulfide, carboranylmethyl, n-butyl sulfide, carboranylmethyl iso-butyl sulfide, carboranylmethyl isopropyl sulfide, and mixtures of the sulfides as the CB plasticizer (i.e., CB plasticizer meaning carborane plasticizer); hydroxy-terminated polybutadiene binder; bonding agent; ammonium perchlorate oxidizer; aluminum metal powder fuel; and toluene diisocyanate cross-linking agent.

The benefits of propellants employing the carboranylmethyl alkyl sulfides are evident by improved processability, improved burning-rate, and improved mechanical properties. High yields of the carboranylmethyl alkyl sulfides which are prepared by the reaction of decarborane and propargyl ethyl sulfide in cyclohexane result in reduction of production cost. With the use of carboranylmethyl alkyl sulfides and fine grind ammonium perchlorate (AP), very-high-burning-rate solid propellants can be achieved at a significant reduction in cost as compared with propellants employing n-hexyl carborane as the plasticizer and burning rate catalyst.

DESCRIPTION OF THE PREFERRED EMBODIMENT

The propellant formulation set forth below, which lists CB-plasticizer along with the other specified ingredients in the amounts shown, is illustrative of a preferred propellant composition of this invention.

PROPELLANT WITH CB PLASTICIZER

| Ingredient | Weight Percent |
|---|---|
| HTPB | 6.05 |
| BA-114 (bonding agent) | 0.35 |
| CB-plasticizer | 13.10 |
| AP ($Al_2O_3$ coated, 2,5μ) | 70.00 |
| Al (Aluminum, A-30) | 10.00 |
| TDI (toluene diisocyanate) | 0.50 |

Comparison tests and studies of a number of these carboranyl sulfides, along with CMP and a carborane-silicon compound (MHTSC) obtained from the Olin Mathieson Company, were carried out and compared with NHC. The carborane (CB) plasticizers tested and compared are listed below as follows:

1. Carboranylmethyl ethyl sulfide (CMES)
2. Carboranylmethyl n-propyl sulfide (CMPS)
3. Carboranylmethyl n-butyl sulfide (CMBS)
4. Carboranylmethyl iso-butyl sulfide (CMIBS)
5. Carboranylmethyl propionate (CMP)
6. 1-Methyl-7-heptamethyltrisiloxanyl-meta-carborane (MHTSC)
7. Eutectic mixture (60% CMES, 40% CMPS).

The propellants (250-gm batches) were processed at 60° C. (140° F.) in a Planetex mixer as follows: HTPB, BA-114, and the carborane plasticizer are added to the mixer and stirred until homogeneous (3 to 5 min) and then the Al is added and the mixture stirred again until fluid. The AP is added over a 1.5- to 2-hour period in 3 to 5 increments, then mixed under vacuum (28 in. Hg) for 2 hours. The temperature is reduced to 43° C., the TDI added; the mixture is again vacuum-mixed for 30 minutes, the viscosity measured, the propellant cast, and then cured at 60° C. for 3 days. Physical properties of CB-plasticizers are compared in Table I. A comparision of the plasticizing effectiveness or processability of the carboranes as well as the quality of the cured propellant is made (Table II). The processability of the sulfides is very good. The lower-molecular-weight sulfides, CMES and CMPS, appeared to be better than NHC. CMP lacked the necessary plasticizing effectiveness. The MHTSC-NHC mixture processed and cured similarly to NHC, but after it stood for several days, considerable plasticizer exudation occurred. Burning-rate data for the propellants are shown in Table III, and the mechanical properties at 77° F. and −40° F. are shown in Table IV.

TABLE I

PHYSICAL PROPERTIES OF CB-PLASTICIZERS

| Carborane | Molecular Weight | % Boron | Melting Point, ° C | Boiling Point (by D. T. A.) |
|---|---|---|---|---|
| CMES | 218.37 | 49.51 | −5 | 326 |
| CMPS | 232.40 | 46.52 | 1-2 | 333 |
| CMBS | 246.43 | 43.87 | −18 | 340 |
| CMIBS | 246.43 | 43.87 | 29-31 | — |
| CMP | 232.33 | 46.53 | 18 | — |
| NHC | 228.3 | 47.34 | −6 | 335 |
| MHTSC* (76%)/ NHC (24%) | — | 33.1 | — | — |

TABLE I-continued

| PHYSICAL PROPERTIES OF CB-PLASTICIZERS | | | | |
|---|---|---|---|---|
| Carborane | Molecular Weight | % Boron | Melting Point, °C | Boiling Point (by D. T. A.) |
| Eutectic Mixture (60% CMES, 40% CMPS) | — | 48.32 | −40 | — |

*MHTSC contains 28.5% boron.

ties. Very low-melting-point plasticizers can be obtained with eutectic mixtures of CMPS and CMES (20 to 80%).

Another important property of the CMES and CMPS propellants is their low vapor pressures. Values for CMES and CMPS are 0.83μ and 0.43μ, respectively, while the value of NHC is 2.3μ.

The carboranylmethyl alkyl sulfides of this invention are prepared by a process which involves the reaction

TABLE II

| PROPELLANT PROCESSING EVALUATION | | | |
|---|---|---|---|
| Plasticizer | Propellant Viscosity (kP) at 110° F (before casting) | Processing of Propellant (Remarks) | Quality of Propellant |
| NHC | 3.5 | Propellant processed well, but during casting it was thick and did not settle in the mold. | The cured propellant has a good appearance except for a few casting voids. |
| CMES | 3.5 | Processed well, cast and settled in mold somewhat better than NHC. | Very good. |
| CMPS | 6.0 | Compared with NHC. | Very good other than a few casting voids. |
| CMBS | 6.0 | Similar to NHC - was possibly more viscous during casting. | Very good. |
| CMIBS | 12.0 | Was more viscous than NHC, particularly below 140° F. | Good - some casting voids were present. |
| CMP | 22.0 | Fair - but had to add 3 increments (0.4% each) of Twitchell* base. | Fair. |
| MHTSC (76%)/ NHC (24%) | 6.0 | Similar to NHC mix. | The propellant cured well and had a good appearance initially, but after standing, considerable plasticizer exudation occurred. |
| Eutectic (60% CMES, 40% CMPS) | 1.5 | Processing appeared to be better than NHC. | Very good appearance. |
| CMES (repeat) | 0.5 | Very good processing - appeared to be better than NHC. | Very good appearance. |

*A commercial base for soluble oils; trademark of Emery Industries, Inc., Cincinnati, Ohio.

TABLE III

| BURNING RATES OF PROPELLANTS CONTAINING CB PLASTICIZERS | | | |
|---|---|---|---|
| Plasticizer | $r_b$ at 2000 psi (in./sec) | $r_b$ at 10,000 psi (in./sec) | Slope [η] |
| CMES | 7.0 | 19.3 | 0.63 |
| CMPS | 6.25 | 17.6 | 0.61 |
| CMBS | 5.85 | 16.0 | 0.62 |
| CMIBS | 6.20 | 16.2 | 0.61 |
| CMP | 6.6 | 17.5 | 0.60 |
| NHC | 6.0 | 14.7 | 0.60 |
| MHTSC (76%)/ NHC (24%) | 5.95 | 14.0 | 0.53 |
| Mixture CMES and CMPS (60/40) | 6.9 | 18.5 | 0.61 |

TABLE IV

| MECHANICAL PROPERTIES OF PROPELLANTS CONTAINING CB PLASTICIZERS | | | | |
|---|---|---|---|---|
| Plasticizer | σ/ε (psi/%) 77° F | Modulus (77° F) | σ/68 (psi/%) −40° F | Modulus (−40° F) |
| CMES* | 195/27.5 | 784.6 | | |
| CMPS** | 142/46.3 | 460.7 | 351.5/22.9 | 2341 |
| CMBS | 126/28.6 | 601.3 | 359.2/37 | 1643 |
| CMIBS | 185.3/35.0 | 712.9 | — | — |
| CMP*** | | | | |
| NHC | 139/50 | 490 | 325/33 | 1740 |
| MHTSC/NHC Mixture****, | 190.7/37.1 | 875.9 | 372.9/20.0 | 2622 |
| CMES CMPS (60/40) | 134.7/74.2 | 307 | 322/41.6 | 1160 |

*Specific gravity = 1.68
**Specific gravity = 1.65
***Physical properties were not obtained on the CMP propellant because of the presence of Twitchell base (Emery Industries, Inc., Cincinnati, O.), added to aid in processing.
****Specific gravity = 1.67.

Indeed, all of the carboranyl sulfides gave good propellant properties. CMES, CMPS, and the eutectic mixture (CMES/CMPS) outperformed NHC in plasticizing effectiveness, burning rate, and physical properties.

of decarborane with the appropriate propargyl alkyl sulfide in cyclohexane. The equation for the reaction is summarized below (equation 2). No added ligand is necessary, since the acetylenic sulfide serves this purpose. Equation (1) illustrates the process for preparation in high yields of propargyl alkyl sulfides employed in reaction (2) as the starting material for preparing the carboranylmethyl alkyl sulfide. The ethyl, propyl, isopropyl, butyl, and isobutyl derivatives were prepared and are represented by Compound I of equation (1) where R equals alkyl.

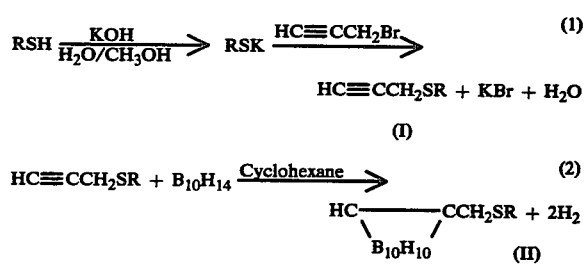

Compound II represents the carboranylmethyl alkyl sulfides of this invention, where R equals alkyl.

The compounds prepared in accordance with the process of this invention include: carboranylmethyl ethyl sulfide (CMES), carboranylmethyl n-propyl sulfide (CMPS), carboranylmethyl iso-propyl sulfide (CMIPS), carboranylmethyl n-butyl sulfide (CMBS), and carboranylmethyl iso-butyl sulfide (CMIBS). Other carboranylmethyl alkyl sulfides having longer chains and/or branched chains can be prepared by first preparing the appropriate propargyl alkyl sulfide by the process outlined above.

The preparation of the carboranylmethyl alkyl sulfides of this invention involves the reaction of decaborane ($B_{10}H_{14}$) and the pertinent propargyl alkyl sulfide using cyclohexane as the reaction solvent.

Representative of the carboranylmethyl alkyl sulfides of this invention is carboranylmethyl ethyl sulfide (CMES) which is prepared by the preferred process set forth hereinbelow.

PREPARATION OF CMES FROM DECABORANE (1-MOLE SCALE)

NOTE: Caution should be exercised in working with decaborane and its derivatives, because of the toxic properties that may be harmful through inhalation as well as skin absorption. Consequently, the reactions associated with decaborane should be carried out in a well-ventilated hood.

Reagents:

(a) 127.3 gm (1.0 mol) of 96% decaborane
(b) 500 ml of cyclohexane (practical grade)
(c) 135.3 gm (1.35 mol) of propargyl ethyl sulfide (PES) (97.9% purity)

Procedure: The apparatus consists of a 1-liter round bottom flask equipped with a chilled water condenser (with Drierite tube), magnetic stirrer, heating mantle, and a bubbler connected to the condenser exit to follow the evolution of hydrogen. For some reactions the evolution of hydrogen is measured by means of a Wet-Test-Meter (Precision Scientific Co.). The decaborane (a) is placed in the flask followed by the addition of the solvent (b). The mixture is stirred until most of the decaborane is dissolved and the PES (c) is added. The solution is brought to reflux temperatures (85° to 87° C.) and allowed to reflux 29 hours. Appropriate precautions should be taken for the evolution of hydrogen for large-scale reactions. The incremental addition of PES may be employed. During the initial part of the reaction (several hours) the evolution of hydrogen is most prominent. After 28 hours the theoretical amount of hydrogen is evolved and essentially no decaborane is detectable in a sample subjected to gas chromatographic analysis. The crude reaction product solution is allowed to cool, transferred to a separatory funnel, washed two times with 300 ml of 10% potassium hydroxide, two times with 300 ml of water (saline solutions may be employed if any difficulty is encountered in separation). The product solution is transferred to simple distillation assembly and the volatile materials, including any excess propargyl ethyl sulfide (no effect was made to recover this material) are distilled (some foaming may occur) until the pot temperature reaches 110° C. The remaining volatiles are removed at reduced pressure (gradually reducing to 1 mm) and at a final pot temperature of 100° C. Finally, the product residue is crude distilled at reduced pressure (0.5 mm) to obtain 175 gm (yield 80%) of product boiling at 110° C. to 130° C. The pot temperature is allowed to reach 160° C. before terminating the distillation.

Purification of the crude-distilled CMES for use in HTPB and fine AP-based propellants is carried out as follows: The CMES is placed on a fairly efficient distillation column (12-inch Vigreux) and pyrolyzed under nitrogen at 150° to 160° C. for two hours, then allowed to cool somewhat, and distilled at reduced pressure (0.1 mm) to obtain a forerun (10.9 gm) boiling at 90° to 112° C. and a main fraction (158 gm) (representing a 72% yield based on decaborane) boiling at 112° to 120° C. The purity is 98.7% (determined by gas chromatography using a Perkin-Elmer 800 with a SR model Sargent Recorder and a 6-ft SF 96-DC 710 packed column). Density ($d_4^{27}$) 1.022; mp, —° C., D.T,A,, endotherm at 326° C.; $KMnO_4$ test, 300 l required for thirty minutes.

Elemental Analyses:

Calc'd for $C_5H_{18}B_{10}S$: C, 27.50; H, 8.31; B, 49.51; S, 14.68. Found: C, 27.8, H, 8.50; B, 49.6: S, 15.5.

Infrared (neat) 3.36 (carboranyl CH) and 3.84 (B-H) CM-[1]; N'NMR; δ1.23 (t, 3, J = 7 Hz, $-CH_3$), δ2.61 (q, 2, J = 7 Hz, $CH_2$), δ4.05 (bs, 1, carboranyl CH). The proton MNR spectrum is measured in $CDCl_3$ employing a Varian A-60 spectrometer and tetramethylsilane as the internal standard.

Since proparyl alkyl sulfide is an essential starting material for use in accordance with the process of this invention several processes were considered for meeting the current needs. The alkylation of mercaptans has been accomplished by (1) coupling alkyl halides, (2) alkyl sulfates, or (3) esters of sulfonic acids with sodium or potassium mercaptides in aqueous or ethanolic solutions, illustrated by the reactions:

$$RSH \xrightarrow{NaOH} RSNa \xrightarrow[R'_2SO_4]{R'X \text{ or}} RSR'.$$

Where R' equals a lower alkyl and X equals halides. Additional information about the reaction type (1), above, is included in the following:

Shriner, Struck, and Jorison, J. Am. Chem. Soc.. 52, 2066 (1930);
Kirner and Richter, J. Am. Chem. Soc., 51, 3135 (1929);
Kipnis and Ornfelt, J. Am. Chem. Soc., 71, 3571 (1949); and
Fehnel and Carmack, J. Am. Chem. Soc., 71, 92 (1949).

Additional information about the reaction type (2), above is included in the following:

Vogel, J. Chem. Soc., 1822 (1948); and,
Tarbell and Fukushima, J. Amer. Chem. Soc., 68, 1458 (1946).

Additional information about the reaction type (3), above, is included in the following:

Gilman and Beaber, J. Am. Chem. Soc., 47, 1449 (1925).

Attempts to prepare propargyl ethyl sulfide (III) by reaction of propargyl bromide, sodium hydroxide, and ethyl mercaptan in ethanol resulted in inconsistent yields (max 75%) and the formation of undesirable impurities.

$$\underset{\text{III}}{HC{\equiv}CCH_2SC_2H_5} \qquad \underset{\text{IV}}{CH_3\overset{O}{\overset{\|}{C}}CH_2SC_2H_5}$$

The hydration product, acetonyl ethyl sulfide (IV) (bp, 42°–46° C. at 5 mm), was identified as one of the main impurities [H'NMR spectrum measured at 60 Hz in $CDCl_3$, $Me_4S$, as std. δ1.23 (t, J = 7 Hz, $—CH_3$), δ2.28 (s, $CH_3—C{=}O$), δ2.52 (q, J = 7 Hz, $—CH_2CH_3$), δ3.25

$$(s, -CH_2\overset{O}{\overset{\|}{C}}-),$$

ir 5.83μ, C=O].

The above method also has the disadvantage of requiring large volumes of water in order to recover the product from the ethanol solvent. Alkylations with alkyl halides in aqueous solutions are not reported. Propargyl ethyl sulfide is prepared by a simplified process (described below) in 85 to 90% yields by reaction at ambient temperatures of propargyl bromide, ethyl mercaptan, and sodium or potassium hydroxide in a water-methanol (2:1) solution. Reaction temperature is critical, in that at elevated temperatures isomerization of the acetylene to allene is pronounced. For example, at reflux temperature (80° C.) formation of approximately 50% allene ethyl sulfide (identified by infrared and proton NMR) occurred in 2.5 hours. No isomerization is observed below 35° C. which is contrary to the teachings of an earlier report, Guy Pourcelot, Paul Codiot, and Antonine Willemart (Ecole Nationale Super Paris) Compt. rend., 252, 1630-2 (1961).

PREPARATION OF PROPARGYL ETHYL SULFIDE BY A SIMPLIFIED PROCESS

Potassium hydroxide (202.0 gm, 3.6 mol) is added to a stirred solution of water (600 ml) and methanol (300 ml) contained in a 3-liter, 3-necked flask equipped with a thermometer, dropping funnel, mechanical stirrer, condenser and water bath. The resulting solution, is heated to 60° C., cooled to 25° C. and ethyl mercaptan (214.3 gm, 3.45 mol) is added (mild exotherm). The reaction temperature is then adjusted to 25° C. by means of an ice water bath and propargyl bromide (357 gm, Columbia Organic Chemical, 96% purity, ~2.88 mol) is added (exotherm) via the dropping funnel over 1.15 hours while the temperature is maintained at 25° to 35° C. (max). After the addition is completed the mixture is stirred 24 hours at room temperature (propargyl bromide content, by gc, trace), then transferred to a separatory funnel, the aqueous layer (lower) drained, the crude product layer is washed two times with 300 ml of water, dried with a small quantity (15 gm) of magnesium sulfate, and filtered. Finally, the product is distilled at reduced pressure (53 mm) through a 10-inch Vigreux column to obtain a forerun (7.7 gm) and a main cut (245 gm) boiling at 56° to 59° C. Yield (main cut), 85%; purity (gas chromatography), 97.7% (propargyl bromide - trace). Reported (Pourcelot et al, supra) bp, 67° C. at 76 mm. IR (neat): 3μ, H—C≡; 5.3μ, C≡C; Proton NMR: measured at 60 Hz in $CDCL_3$, $ME_4S$: at std. δ 1.28 (S, J = 7 Hz, —$CH_3$), δ 2.71 (quartet, J = 7 Hz, —$CH_2$—adjacent to —$CH_3$), δ 2.73 (multiplet, H—C≡C) δ 3.26 (d, J = 3 Hz, —$CH_2$— adjacent to C≡C).

The carboranylmethyl alkyl sulfides of this invention serve as plasticizers for propellants and are very effective burning-rate promoters. These compounds are used with other propellant ingredients comprised of polybutadiene binder, bonding agent, ammonium perchlorate oxidizer, aluminum metal fuel, and a crosslinking agent appropriate for reaction with the binder, such as toluene diisocyanate crosslinking agent when hydroxyl terminated polybutadiene is the binder material or epoxy resins as crosslinking agent or crosslinking agents such as MAPO (brand name for tris[1-(2-methyl)-aziridinyl]-phosphine oxide) when carboxy terminated polybutadiene is the binder material. The aforementioned crosslinking agents in combination with a binder of polybutadieneacrylic acid copolymer, the carboranylmethyl alkyl sulfides of this invention, and the other stated propellant ingredients also yield propellant compositions having attractive properties and burning rates.

The bonding agent (BA-114) employed in the propellant compositions of this invention is added for the purpose of improving the mechanical properties of the cured propellant. The bonding agent functions as an interfacial bonding agent because it reacts with the ammonium perchlorate and the binder to form a chemical bond. When the propellant is then cured, a highly crosslinked network is produced among the AP, the binder and other propellant ingredients.

The interfacial bonding agents employed in the propellant formulations of this invention may be derived from di- or tri-functional aziridinylphosphine oxides or their derivatives with polyfunctional carboxylic acids as specifically set forth in a commonly assigned Patent Application Ser. No. 851,137, filed July 30, 1969. The nominal structure of the reaction product may be represented by the following general formula:

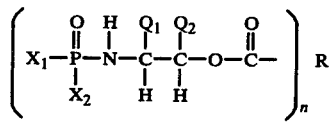

Where $X_1$ represents an aziridinyl group of the structure:

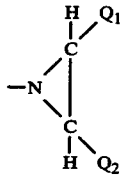

and $Q_1$ and $Q_2$ are either hydrogen or alkyl groups of one to four carbon atoms ($Q_1$ and $Q_2$ may be the same or different), $X_2$ may be the same as $X_1$ or may be an organic radical such as phenyl, benzyl, ethyl etc., R is an alkyl that contains at least one active hydrogen atom or an organic entity of molecules that contain one or more hydroxyl groups, and n is 2, 3, or 4.

The reaction product described above, is produced by dissolving the reactants in a suitable inert organic solvent such as methanol, ethanol, methylene chloride, tetrahydrofuran, diethyl ether, or mixtures of these. It has been found to be preferable that methanol or ethanol comprise at least a part of the solvent. Reaction temperature is not critical, and may range from 70° F. to 200° F. for such time as is needed for essentially all carboxyl groups to be reacted. The solvent is then removed by any suitable means, such as evaporation under vacuum at elevated temperatures. The residue is the reaction product, an interfacial bonding agent, which is usually straw-colored and quite viscous.

The CB plasticizers or carboranylmethyl alkyl sulfides of this invention are generally used in amounts from about 5 to about 20 weight percent of the propellant composition. The plasticizers may be used with or without an interfacial bonding agent. The ammonium perchlorate oxidizer is used in amounts from about 50 to about 75 weight percent of the propellant composition. The polybutadiene type binders are used in amounts from about 5 to about 20 weight percent of the propellant composition. The aluminum metal is used in amounts from about 5 to about 20 weight percent of the propellant composition. The bonding agent is used in amounts from about 0.1 to about 0.5 weight percent of the propellant compositions. The bonding agent is optional and when used extra strength is provided for high content ammonium perchlorate propellants. The crosslinking agents (TDI, MAPO, and the like) are used in amounts from about 0.5 to about 2 weight percent of the propellant composition. Additives for special ballistic properties desired may be used in trace amount. Processing aids (lecithin) may also be used in trace amounts.

I claim:

1. A propellant composition comprising a binder selected from the group consisting of hydroxy terminated polybutadiene, carboxy terminated polybutadiene, and polybutadiene-acrylic acid copolymer; ammonium perchlorate oxidizer; aluminum metal; a crosslinking agent selected from the group consisting of toluene diisocyanate, epoxy resins, and tris[1-(2-methyl)-aziridinyl]phosphine oxide, said crosslinking agent selected being a crosslinking agent that is reactive with said binder selected; and a carboranylmethyl alkyl sulfide plasticizer selected from the group consisting of carboranylmethyl ethyl sulfide, carboranylmethyl n-propyl sulfide, carboranylmethyl iso-propyl sulfide, carboranylmethyl n-butyl sulfide, carboranylmethyl iso-butyl sulfide, and mixtures of said carboranylmethyl alkyl sulfides.

2. The propellant composition of claim 1 wherein said binder is used in amounts from about 5 to about 20 weight percent of said propellant composition; said ammonium perchlorate oxidizer is used in amounts from about 50 to about 75 weight percent of said propellant composition; said crosslinking agent is used in amounts from about 0.5 to about 2 weight percent of said propellant composition; said carboranylmethyl alkyl sulfides are used in amounts from about 5 to about 20 weight percent of said propellant composition; and wherein an interfacial bonding agent is employed as an additional ingredient in said propellant composition, said bonding agent being used in amounts from about 0.1 to about 0.5 weight percent of said propellant composition, said bonding agent being a reaction product derived from di or tri-functional aziridinylphosphine oxides or their derivatives with polyfunctional carboxylic acids, said reaction product being represented by the following general formula:

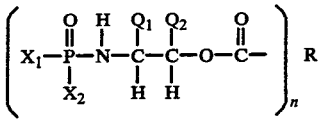

Where $X_1$ represents an aziridinyl group of the structure:

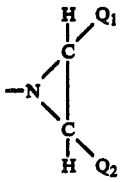

and $Q_1$ and $Q_2$ are either hydrogen or alkyl groups of one to four carbon atoms ($Q_1$ and $Q_2$ may be the same or different), $X_2$ may be the same as $X_1$ or may be an organic radical such as phenyl, benzyl, ethyl, etc., R is an alkyl that contains at least one active hydrogen atom or an organic entity of molecules that contain one or more hydroxyl groups, and n is 2, 3, or 4.

3. The propellant composition of claim 2 wherein said binder is hydroxy terminated polybutadiene which is used in an amount of about 6.05 weight percent of said propellant composition; said ammonium perchlorate oxidizer is used in an amount of about 70.0 weight percent of said propellant composition; said crosslinking agent is toluene diisocyanate which is used in an amount of about 0.50 weight percent of said propellant composition; said aluminum is used in an amount of about 10.00 weight percent of said propellant composition; said bonding agent is used in an amount of about 0.35 weight percent of said propellant composition; and said carboranylmethyl alkyl sulfide is used in an amount of about 13.10 weight percent of said propellant composition.

4. The propellant composition of claim 3 wherein said carboranylmethyl alkyl sulfide is carboranylmethyl ethyl sulfide.

5. The propellant composition of claim 3 wherein said carboranylmethyl alkyl sulfide is carboranylmethyl n-propyl sulfide.

6. The propellant composition of claim 3 wherein said carboranylmethyl alkyl sulfide is carboranylmethyl n-butyl sulfide.

7. The propellant composition of claim 3 wherein said carboranylmethyl alkyl sulfide is carboranylmethyl iso-butyl sulfide.

8. The propellant composition of claim 3 wherein said carboranylmethyl alkyl sulfide is carboranylmethyl iso-propyl sulfide.

9. The propellant composition of claim 3 wherein said carboranylmethyl alkyl sulfide is a eutectic mixture of carboranylmethyl ethyl sulfide and carboranylmethyl n-propyl sulfide, said eutectic mixture containing from about 20 weight percent to about 40 weight percent carboranylmethyl n-propyl sulfide mixed with from about 60 weight percent to about 80 weight percent of carboranylmethyl ethyl sulfide.

10. The propellant composition of claim 9 wherein said eutectic mixture contains about 40 weight percent carboranylmethyl n-propyl sulfide and about 60 weight percent carboranylmethyl ethyl sulfide.

* * * * *